United States Patent [19]

Oe et al.

[11] Patent Number: 4,640,453

[45] Date of Patent: Feb. 3, 1987

[54] APPARATUS FOR FABRICATING MULTI-LAYER SPIRAL TUBES

[75] Inventors: Tsutomu Oe; Shigeaki Kimura; Yoshinori Yuzaki; Tadao Ozaki, all of Hiroshima, Japan

[73] Assignee: Mitsubishi Jukogyo Kabushiki Kaisha, Tokyo, Japan

[21] Appl. No.: 780,078

[22] Filed: Sep. 25, 1985

[30] Foreign Application Priority Data

Oct. 13, 1984 [JP] Japan ..... 59-215015

[51] Int. Cl.[4] ..... B23K 5/02

[52] U.S. Cl. ..... 228/17.7; 228/145

[58] Field of Search ..... 228/7, 9, 17, 17.7, 228/102, 103, 125, 130, 145, 147, 162; 72/49, 50, 199

[56] References Cited

U.S. PATENT DOCUMENTS

| | | | |
|---|---|---|---|
| 3,208,138 | 9/1965 | Eckhardt | 228/103 |
| 3,267,570 | 8/1966 | Winkler | 228/103 |
| 3,357,087 | 12/1967 | Barnikel et al. | 228/103 |
| 3,845,645 | 11/1974 | Gebauer | 228/17 |
| 3,851,376 | 12/1974 | Gross et al. | 228/103 |
| 3,997,097 | 12/1976 | Embury | 228/17.7 |
| 4,163,886 | 8/1979 | Omae et al. | 228/9 |
| 4,436,239 | 3/1984 | Tsuyama et al. | 228/145 |

FOREIGN PATENT DOCUMENTS

| | | | |
|---|---|---|---|
| 55-50998 | 4/1980 | Japan | 228/103 |

*Primary Examiner*—M. Jordan

*Attorney, Agent, or Firm*—Wenderoth, Lind & Ponack

[57] ABSTRACT

An apparatus for fabricating multi-layer spiral tubes including first drive means for performing rotation of an inner cylinder around which a web is to be wrapped spirally a slide base moveable along the longitudinal direction of the inner cylinder, the slide base being disposed on a bed so as to be slidable along the longitudinal direction of the inner cylinder, a plurality of pairs of cradles mounted on the slide base for placing the inner cylinder thereon, first depressing rolls for wrapping the web, second depressing rolls for constraining a weld portion of the web, an automatic gap detector for detecting a gap between adjacent edge portions of the wrapped web, an automatic welding machine for welding edge portions of the wrapped web, an automatic grinding machine for grinding excess metal of welding, an automatic defect hunter for detecting defects in the weld portion, a web feed table for feeding the web, second drive means for moving the web feed table, and a central control unit is provided and coupled to the first drive means, the cradles, the first depressing rolls, the second depressing rolls, the automatic gap detector, the automatic welding machine, the automatic grinding machine, the automatic defect hunter, the web feed table and the second drive means, for controlling the operations of these component means in a concentrated manner.

1 Claim, 4 Drawing Figures

APPARATUS FOR FABRICATING MULTI-LAYER SPIRAL TUBES

BACKGROUND OF THE INVENTION

1. Field of the Invention

The present invention relates to an apparatus for fabricating multi-layer spiral tubes in which the multi-layer spiral tube is formed by spirally wrapping a web in a plurality of layers, and especially to such an apparatus which can be favorably utilized for fabrication of a cylinder section of a high-pressure pressurized container, a large-diameter steel tube for high-pressure piping, or the like.

2. Description of the Prior Art

Heretofore, upon fabrication of thick-walled large-diameter tubular materials, an apparatus for fabricating tubes according to a spiral wrapping system has been employed. Since this apparatus forms a multi-layer spiral tube by wrapping a web around an inner tube which serves as an inner lining, it can fabricate a thick-walled large-diameter tube having an arbitrary diameter without being restricted by the width of the web, and moreover, it can easily achieve even multi-layer wrapping, so that after it is used generally to fabricate a large-diameter cylinder for high-pressure use such as a cylinder for a high-pressure pressurized container or a large-diameter steel tube for high-pressure piping.

With regard to the above-referred apparatus for fabricating tubes according to a spiral wrapping system, reference could be made to the disclosure in, for instance, Japanese Laid-Open Utility Model Specification No. 57-52237.

In such type of apparatus in the prior art, due to the fact that the respective means for performing rotation of an inner cylinder and movement in the longitudinal direction thereof upon spirally wrapping a web, feeding and wrapping of the web, welding of adjacent edge portions of the web, and grinding of excess metal of welding were not adapted to operate in correlation with one another, operators had to be posted at the respective means and variations of operating conditions had to be responded according to individual judgement of every operator. In addition, due to the fact that the operations of wrapping the web, welding the edge portions of the web, grinding excess metal of welding and non-destructively inspecting the welded portions has to be carried out separately, a lot of labor was necessitated. Furthermore, upon wrapping the web around the inner cylinder, for the purpose of bringing the web into tight contact with the inner cylinder and minimizing the gap clearance between the layers it was necessary to urge the web against the inner cylinder by means of depressing rolls, but it was extremely difficult to apply a proper urging force because the urging forces of the respective rolls had to be manually adjusted. Consequently, often degradation of quality of the products was resulted due to partial increase of the gap clearance between the layers, non-uniformity of the gap between the adjacent edge portions of the web, or generation of a gap clearance between the layers in the peripheral portions of the weld caused by welding strain. Accordingly, the known fabricating apparatus in the prior art had a shortcoming that it cannot fabricate multilayer spiral tubes of high quality and low cost.

SUMMARY OF THE INVENTION

It is a principal object of the present invention to provide an apparatus for fabricating multi-layer spiral tubes which is free from the above-mentioned shortcoming of the known apparatus in the prior art.

A more specific object of the present invention is to provide an improved apparatus for fabricating multi-layer spiral tubes in which control of the respective component means is achieved automatically according to a central command system to reduce the number of operators and to enable the respective component means to momentarily respond to variations of the operating conditions, and thereby continuous operation of the apparatus is made possible.

In order to obviate the above-mentioned shortcoming in the prior art, according to the present invention, there is provided a central control unit containing a computer therein, the respective component means are provided with necessary sensors, these sensors are coupled to the central control unit, which momentarily analyzes the data input from the respective sensors and issues operation commands to the respective component means according to a concentrated control system, and thereby the fabricating apparatus is made to automatically respond to variations of the operating conditions. In addition, according to the present invention, wrapped portions of the web are urged against the inner cylinder by means of depressing rolls for wrapping to perform welding of the adjacent edge portions of the web while maintaining them at that position, and furthermore, the proximity of the already welded portion is also constrained under pressure by means of other depressing rolls for constraining a weld portion to thereby prevent swelling of the steel web caused by welding strain.

According to one feature of the present invention, there is provided an apparatus for fabricating multi-layer spiral tubes, comprising first drive means for performing rotation of an inner cylinder around which a web is to be wrapped spirally, a slide base moveable along the longitudinal direction of the inner cylinder, a plurality of pairs of cradles mounted on said slide base for placing the inner cylinder thereon, first depressing rolls for wrapping the web, second depressing rolls for constraining a weld portion of the web, an automatic gap detector for detecting a gap between adjacent edge portions of the wrapped web, an automatic welding machine for welding edge portions of the wrapped web, an automatic grinding machine for grinding excess metal of welding, an automatic defect hunter for detecting defects in the weld portion, a web feed table for feeding the web, second drive means for moving the web feed table, and a central control unit coupled to the first drive means, the cradles, the first depressing rolls, the second depressing rolls, the automatic gap detector, the automatic welding machine, the automatic grinding machine, the automatic defect hunter, the web feed table and the second drive means, to control the operations of these component means in a concentrated manner.

In operation, at first, an outer diameter dimension of the inner cylinder, a width dimension of the web and a prescribed dimension of the gap between the adjacent edge portions of the web are input to the central control unit. In the central control unit, an angle of wrapping the web around the inner cylinder is calculated from these input data, and on the basis of the calculated wrapping angle, commands are issued from the central control unit to automatic hydraulic pressure control devices for the depressing rolls for wrapping and the depressing rolls for constraining the weld portion, the automatic welding machine, the automatic grinding machine and the drive means for the web feed table, respectively, so that the respective component means are set at predetermined positions, respectively.

Subsequently, the web is delivered from the web feed table, the tip end portion of the web is fixed to the inner cylinder as by temporary welding or the like, then an elevator table is lowered down to a predetermined position, the depressing rolls for wrapping are urged against the web by means of the automatic hydraulic pressure control devices, and thereby the web is brought into tight contact with the inner cylinder. Under this condition, the slide base is fed in the axial direction of the inner cylinder while rotating the inner cylinder by actuating the first drive means, and thereby while the web is being wrapped spirally around the inner cylinder, the adjacent edge portions of the web are welded together by means of the automatic welding machine. At this moment, in the central control unit, the rotational speed of the inner cylinder and the feeding speed of the slide base are calculated from the outer diameter dimension of the inner cylinder, the width dimension of the web, the prescribed dimension of the gap between the edge portions, the wrapping angle and the prescribed welding speed, and on the basis of these calculated speeds a command is issued from the central control unit to the first drive means to control the operation of the drive means.

The gap between the adjacent edge portions of the web to be welded together is continuously monitored by the automatic gap detector, the detected data are input to the central control unit, which analyzes the data momentarily to issue a command to the automatic hydraulic pressure control device of the depressing rolls for wrapping and thereby controls the urging force against the steel web of the depressing rolls for wrapping, and which also issues a command to the second drive means for the web feed table to make fine adjustment of the position of the web feed table, whereby automatic adjustment can be achieved so that the above-referred gap can be maintained within a tolerance of the prescribed dimension.

In the automatic welding machine, welding of the edge portions of the web is carried out while a position of a welding wire is automatically adjusted so that a welding arc may be generated always at the center of the gap. The depressing rolls for constraining the weld portion are urged against the proximity of the welded edge portions of the web by means of the automatic hydraulic pressure control device to constrain under pressure the opposite sides of the weld portion jointly with the depressing rolls for wrapping, and thereby swelling of the web caused by welding strain can be prevented. The completely welded portion has excess metal of welding ground by the automatic grinding machine, furthermore defects in the weld portion are detected by the automatic defect hunter, and the defect hunting data are sent to the central control unit and recorded there. It is to be noted that the cradles mounted on the slide base would support the inner cylinder as well as the web wrapped around the inner cylinder, and they can automatically sense the difference in load between the case of supporting only the inner cylinder and the case of supporting the inner cylinder wrapped with the web. In the respective cases, an interval between supporting rolls in each cradle is adjusted according to a command issued from the central control unit so as to respond to the variation of the above-mentioned load.

The above-mentioned and other objects, features and advantages of the present invention will become more apparent by reference to the following description of one preferred embodiment of the invention taken in conjunction with the accompanying drawings.

DESCRIPTION OF A PREFERRED EMBODIMENT

Figure 1:
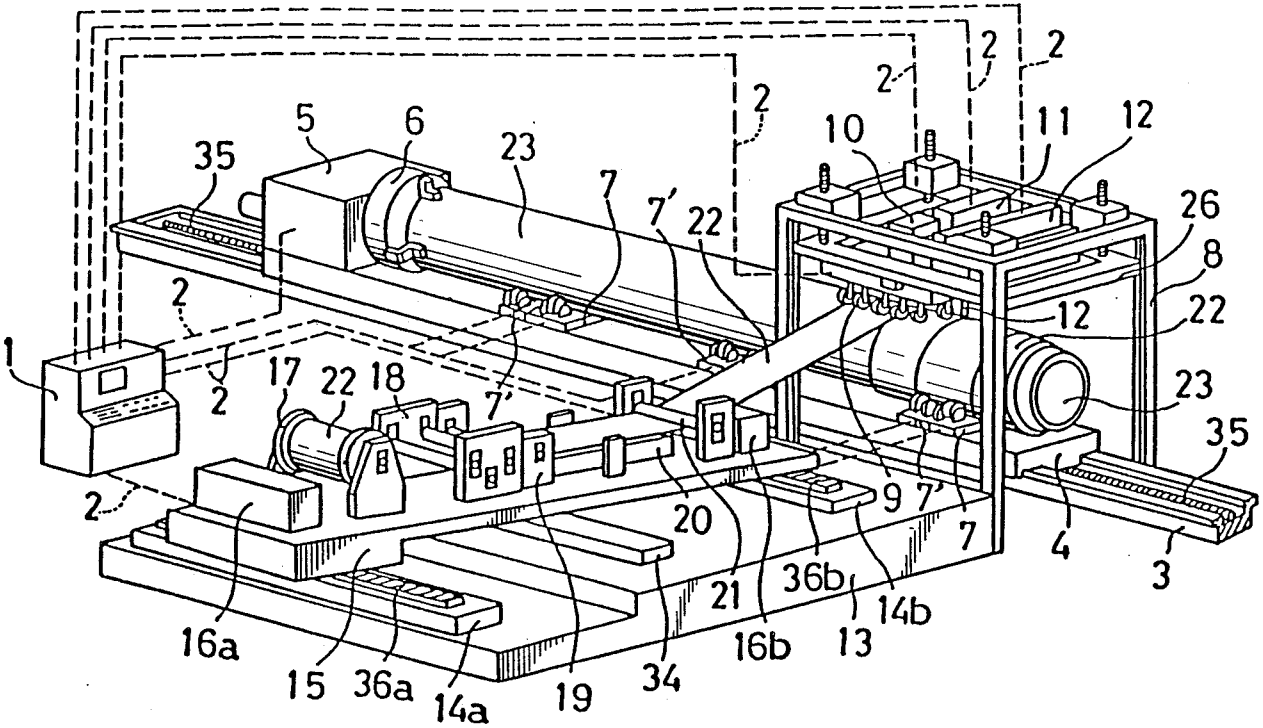
FIG. 1 is a perspective view showing an external appearance of an apparatus for fabricating multi-layer spiral tubes according to one preferred embodiment of the present invention.
Figure 2:
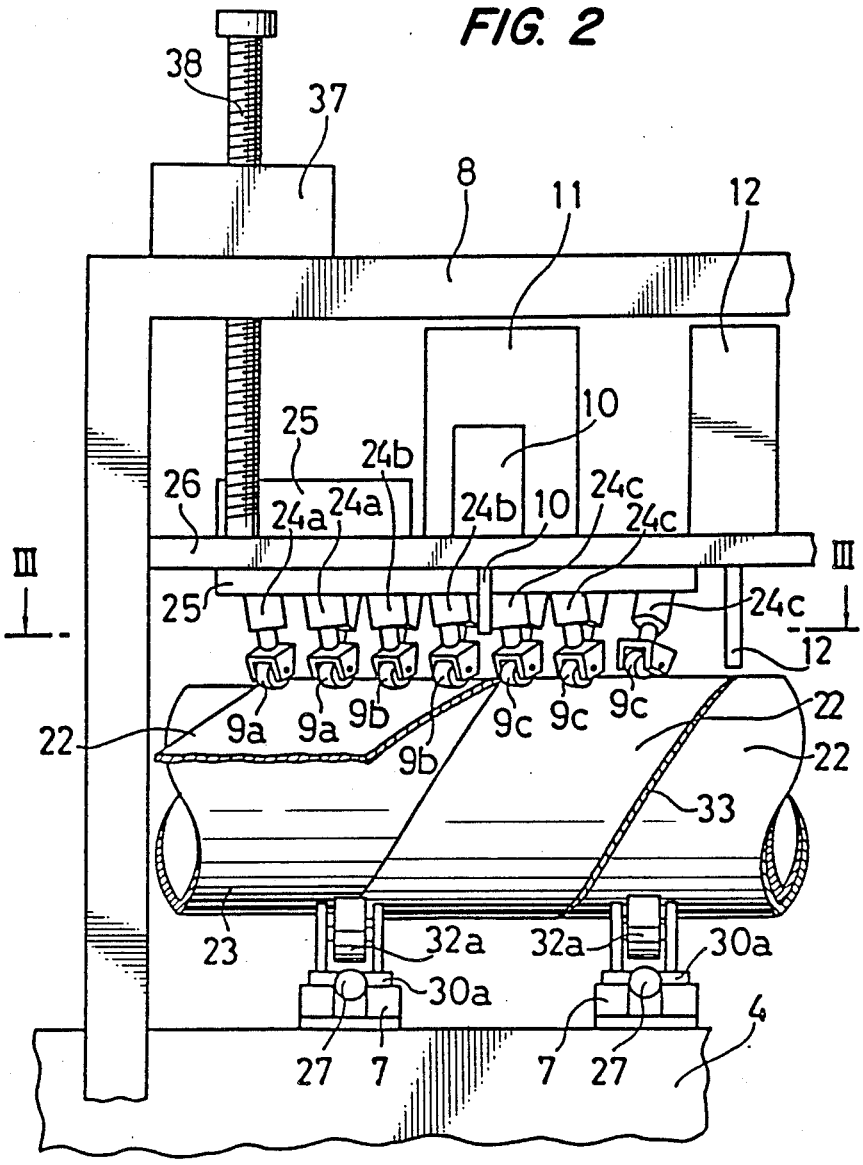
FIG. 2 is an enlarged front view of a wrapping and welding section of the same apparatus.
Figure 3:
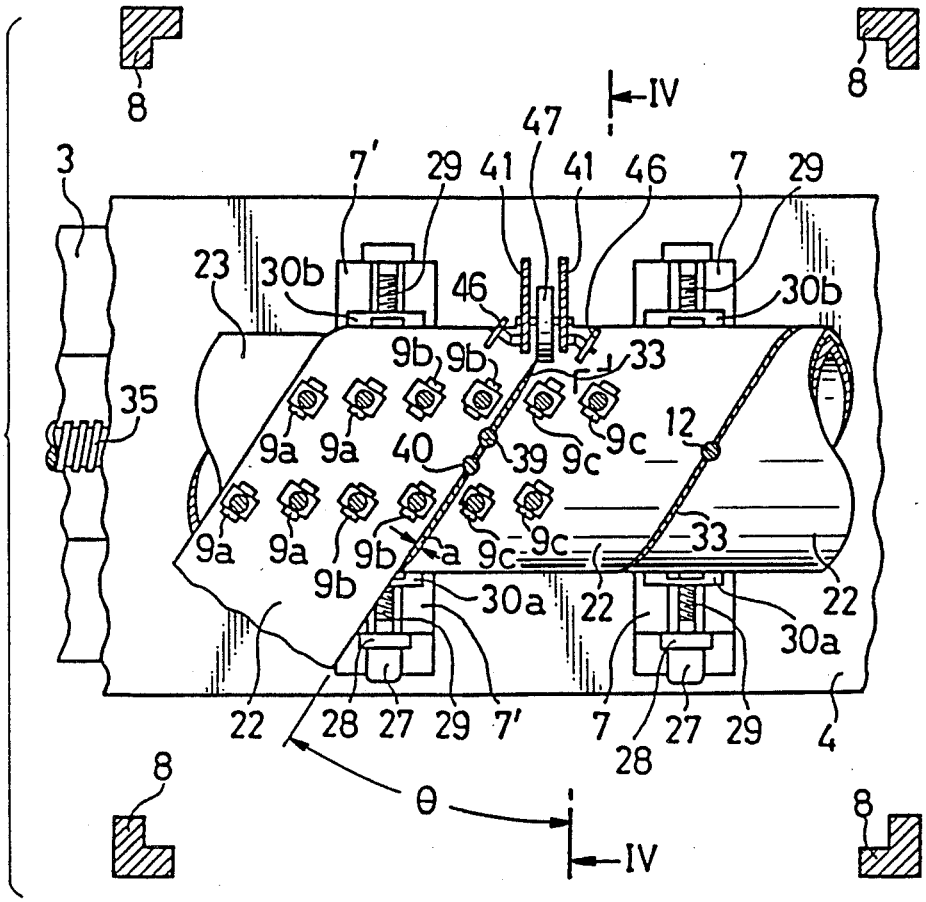
FIG. 3 is a horizontal cross-section view of the same section taken along line III—III in FIG. 2 as viewed in the direction of arrows.
Figure 4:
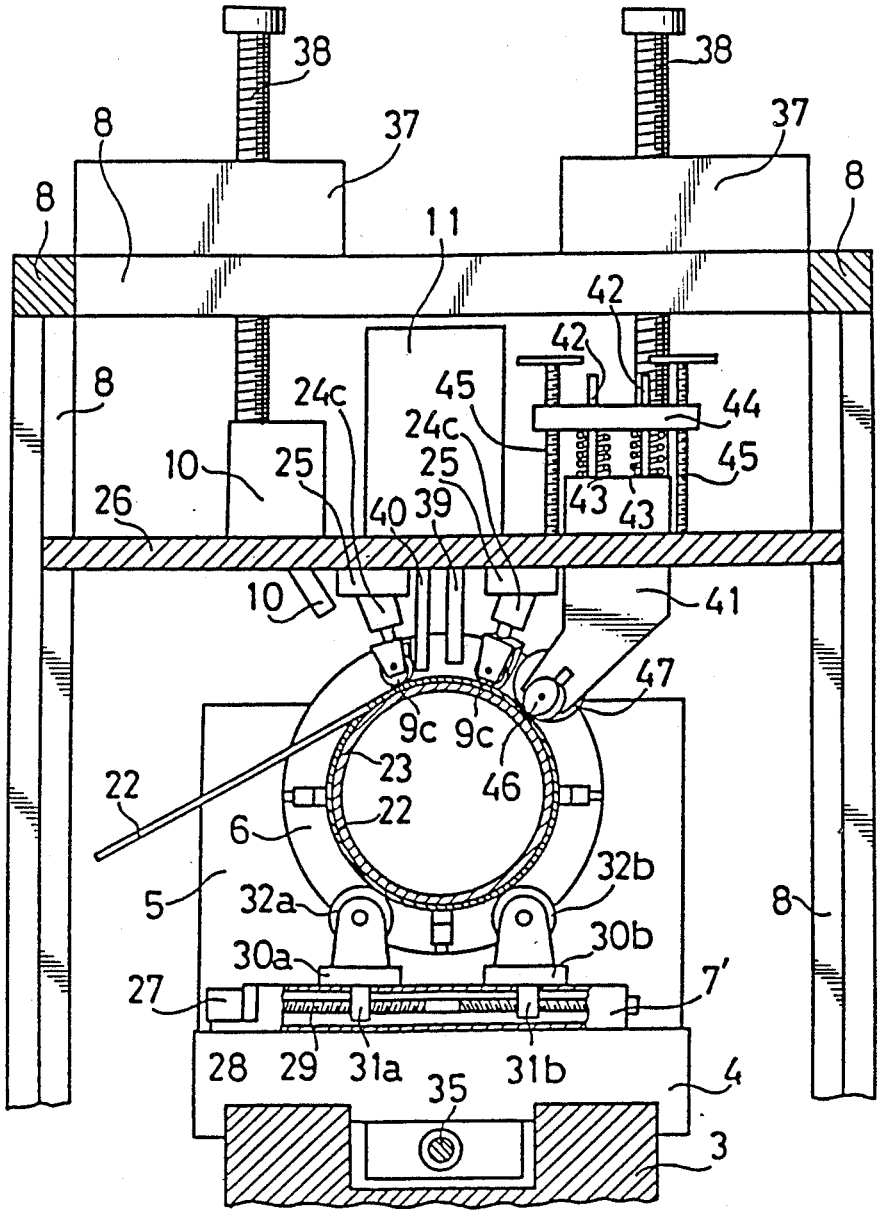
FIG. 4 is a vertical cross-section view of the same section taken along line IV—IV in FIG. 3 as viewed in the direction of arrows.

As shown in FIG. 1, a central control unit 1 containing a computer (not shown) therein is coupled via wirings 2 with various devices as will be described later so that data input and operation command may be achieved between the central control unit 1 and the respective devices.

A slide base 4 is slidably mounted on a bed 3 which is in turn fixedly disposed on a floor of a factory, and on the slide base 4 are mounted a drive mechanism 5 and a plurality of pairs of cradles 7, 7'. On the bed 3 is fixedly disposed a lead screw 35 as directed in the longitudinal direction of the bed 3, so that feed of the slide base 4 in its longitudinal direction may be carried out by rotation of a feed nut not shown which is provided within the drive mechanism 5 and threadedly mated with the lead screw 35. A chuck 6 for gripping an inner cylinder to rotate it is coupled to the drive mechanism 5, and the rotational axis of the inner cylinder 23 is set in parallel to the direction of feed of the slide base 4. An elevator table 26 is provided in a frame structure 8 erected on the floor surface as straddling the bed 3, and on this elevator table 26 are mounted an automatic laser gap detector 10, an automatic welding machine 11, an automatic grinding machine 41 for excess metal of welding and an automatic magnetic defect hunter 12. On the other hand, on a base plate 13 disposed on the floor surface are fixedly disposed slide beds **14*a*, 14*b* and 34, and among these slide beds, on the slide beds 14*a* and 14*b* for driving are mounted arcuately curved racks 36*a* and 36*b*, respectively. On the slide beds 14*a*, 14*b* and 34 is placed a steel web feed table 15, and on this steel web feed table 15 are disposed driving devices 16*a* and 16*b*, a pay-off reel 17, a leveler 18, pinch rolls 19, a guide 20 and tension rolls 21. Within the above-mentioned driving devices 16*a* and 16*b* are provided pinions not shown, so that the steel web feed table 15 can be moved over a sector-shaped region whose center is located at a steel web wrapping section as will be described later, by rotating these pinions as meshed with the racks 36*a* and 36*b*, respectively. On the elevator table 26 which is provided in the frame structure 8 in a vertically movable manner, are disposed two automatic hydraulic pressure control devices 25 (one being provided for use with depressing rolls for wrapping, and the other being provided for use with other depressing rolls for constraining a weld portion), which are individually and respectively movable, and which are respectively provided with hydraulic cylinders 24***a*, 24*b* and 24*c* having depressing rolls 9*a* and 9*b* for wrapping a steel web and depressing rolls 9*c* for constraining a weld portion of the steel web, respectively, mounted at their tip end portions. Every one of these devices including the previously described ones is adapted to be commanded to operate from the above-described central control unit 1 or to input data to the central control unit 1. A depressing roll group 9 is formed of the depressing rolls 9*a* and 9*b* for wrapping a steel web and the depressing rolls 9*c* for constraining the weld portion of the steel web, which rolls are mounted on the hydraulic cylinders 24*a*, 24*b* and 24*c*, respectively, the urging forces of these rolls against the inner cylinder 23 can be adjusted individually and respectively, and also provision is made such that the directions of these urging forces can be adjusted in accordance with an angle $\theta$ of wrapping a steel web 22 around the inner cylinder 23. It is to be noted that in the illustrated embodiment the above-mentioned depressing rolls 9*a*, 9*b* and 9*c*, respectively, are provided in two pairs. The elevator table 26 is supported from elevator screws 38 mounted to the frame structure 8, and is adapted to slide vertically with the four corners of the elevator table 26 kept in contact with the inner surfaces of the four posts of the frame structure 8 so as to withstand external forces in the horizontal directions, and the height of the elevator table 26 can be adjusted by rotating a feed nut not shown provided within an elevator 37 fixedly secured to the frame structure 8. In the cradles 7 and 7' for supporting the inner cylinder which are mounted in pairs on the slide base 4, are provided a motor 27, a reduction gear 28, a screw 29 having a left-handed screw thread and a right-handed screw thread for moving roll bases 30*a* and 30*b*, supporting rolls 32*a* and 32*b*, roll bases 30*a* and 30*b* containing an abnormal weight sensor not shown for sensing a weight loaded upon the supporting rolls 32*a* and 32*b*, and feed nuts 31*a* and 31*b* having a left-handed screw thread and a right-handed screw thread, respectively, and fixedly secured to the roll bases 30*a* and 30*b*, and by driving the motor 27 to rotate the screw 29, the roll bases 30*a* and 30*b* and the supporting rolls 32*a* and 32*b* are moved in the opposite directions to each other via the feed nuts 31*a* and 31*b*. In the automatic welding machine 11 mounted on the elevator table 26, are provided a welding wire feed nozzle 39 and a nozzle guide 40, and so, during the welding operation the position of the welding wire feed nozzle 39 can be finely adjusted in an automatic manner as guided by the nozzle guide 40. In the automatic grinding machine 41 for grinding excess metal of welding, are provided a grinding wheel 47 that is rotated by a motor not shown but contained within the machine, two guide rolls 46 which can be adjusted in height and direction depending upon the wrapping angle $\theta$ and which can freely roll along the surface of the wrapped steel web 22, and four sets of springs 43 for urging the grinding wheel 47 against the weld portion and slide shafts 42, and this grinding machine 41 is mounted on a frame table 44. This frame table 44 is mounted on the elevator table 26 via four elevator screws 45, so that the height of the automatic grinding machine 41 as well as the urging pressure of the grinding wheel 47 can be adjusted by manually rotating the elevator screws 45.

The inner cylinder 23 is placed on the cradles 7 and 7' which are in turn mounted on the slide base 4, and is fixedly secured to a chuck 6. In order to wrap the steel web 22 spirally around the inner cylinder 23, at first the outer diameter dimension of the inner cylinder 23, the width dimension of the steel web 22 and the prescribed dimension of the gap a between the adjacent edge portions of the steel web are input to the central control unit 1. Then, in the central control unit 1, the wrapping angle $\theta$ is calculated, and commands are issued to the automatic hydraulic pressure control devices 25, the automatic welding machine 11, the automatic grinding machine 41 and the driving devices 16*a* and 16*b* for the steel web feed table. Thus, the positions of the automatic hydraulic pressure control devices 25, the directions of the depressing rolls 9*a*, 9*b* and 9*c*, the position of the automatic welding machine 11, the position of the automatic grinding machine 41 and the position of the steel web feed table 15 corresponding to the wrapping angle $\theta$ are set. The steel web feed table 15 is at the predetermined angle by rotating pinions not shown but provided within the driving devices 16*a* and 16*b* for the steel web feed table as meshed with the arcuate racks 36*a* and 36*b* on the slide bed 14*a* and 14*b*, in accordance with a command issued from the central control unit 1. The steel web, in a coil shape, is mounted on the pay-off reel 17 provided on the steel web feed table 15 and is delivered by rotating the payoff reel 17, after it has been flattened through the leveler 18, it is fed through the pinch rolls 19, the guide 20 and the tension roll 21 to the wrapping section for the inner cylinder 23, then the tip end portion of the web is cut away in parallel to the end of the inner cylinder 23, and it is fixed to the inner cylinder 23 by temporary welding. Subsequently, the elevator table 26 is lowered down to a predetermined position, the depressing rolls 9*a* and 9*b* for wrapping the steel web are urged against the steel web 22 by the hydraulic cylinders 24*a* and 24*b*, thereby the steel web 22 is brought into tight contact with the inner cylinder 23, and the automatic laser gap detector 10, the wire feed nozzle 39 and nozzle guide 40 of the automatic welding machine 11, the automatic grinding machine 41 and the automatic magnetic defect hunter 12 are disposed at predetermined positions. The drive mechanism 5 rotates the inner cylinder 23 fixedly secured to the chuck 6 and also feeds the inner cylinder 23 in its axial direction jointly with the slide base 4 by rotating a feed nut not shown that is threadedly mated with the lead screw 35, and thereby the steel web 22 is spirally wrapped around the outer circumferential surface of the inner cylinder 23. In the central control unit 1, the rotational speed of the inner cylinder 23 and the rotational speed of the feed nut within the drive mechanism 5 are calculated on the basis of the outer diameter dimension of the inner cylinder 23, the width dimension of the steel web 22, the prescribed dimension of the gap a, the wrapping angle $\theta$ and the prescribed welding speed which were preliminarily input to the central control unit, and thereby an amount of axial feed per one revolution of the inner cylinder 23 is determined. The rotational speed of the inner cylinder 23 is determined so that the traveling speed of the edge portion of the steel web 22 may become equal to the prescribed welding speed. When the above-described rotational speed and feed speed of the inner cylinder 23 have been determined, a command is issued from the central control unit 1 through the wiring 2 to the drive mechanism 5, and the rotations of the chuck 6 and the feed nut within the drive mechanism 5 are automatically controlled.

When the steel web 22 is wrapped spirally around the inner cylinder 23 in the above-described manner, in the event that dispersion should occur in the dimensions of the gap a due to a dimension error of the inner cylinder 23, zig-zag movement of the steel web 22 or the like and hence the gap dimension should not fall within a tolerance of the prescribed value, welding of the adjacent edge portions of the steel web 22 would become difficult. Therefore, in order to preclude this difficulty, the gap a is continuously irradiated by a laser beam projected from the above-mentioned automatic laser gap detector 10, the reflected data are sent to the central control unit 1 to monitor the dimension of the gap a, and a feedback command corresponding to the variation of the gap a is issued from the central control unit 1 to achieve automatic control. More particularly, the central control unit 1 momentarily analyzes the data input from the automatic gap detector 10 and issues a command to the automatic hydraulic pressure control devices 25, so that the hydraulic pressures in the hydraulic cylinders 24*a* and 24*b*, respectively, for the respective depressing rolls 9*a* and 9*b* for wrapping the steel web can be automatically controlled. If the gap a becomes broader during wrapping of the steel web 22, then the hydraulic pressure in the hydraulic cylinders 24*a* on the side of the drive mechanism 5 is raised to enhance the urging forces of the depressing rolls 9*a* for wrapping, and thus the gap a is narrowed by increasing the tension in the portion of the steel web 22 on the side of the drive mechanism 5. On the contrary, if the gap a becomes narrower, the hydraulic pressure in the hydraulic cylinders 24*b* on the side of the gap a is raised to enhance the urging forces of the depressing rolls 9*b* for wrapping, and thus the gap a is broadened by increasing the tension in the portion of the steel web 22 on the side of the gap a. In addition, the central control unit 1 sends commands corresponding to the dimension variation of the gap a also to the driving devices 16*a* and 16*b* for the steel web feed table to rotate the pinions (not shown) meshed with the arcuate racks 36*a* and 36*b* on the slide beds 14*a* and 14*b*, respectively, within the driving devices 16*a* and 16*b*, and thus the wrapping angle $\theta$ is finely adjusted by finely swinging the steel web feed table 15 in a sector-shaped region having its center at the wrapping station of the steel web 22. Thereby the tensions in the opposite side portions of the steel web 22 can be adjusted, and in cooperation of the above-described adjustment by means of the depressing rolls 9*a* and 9*b* for wrapping, adjustment is achieved so that the gap a may be always maintained within a tolerance of the prescribed dimension.

While the steel web 22 is being wrapped around the inner cylinder 23, a step of the height corresponding to the sheet thickness of the steel web 22 is formed between the unwrapped surface of the inner cylinder 23 and the surface of the wrapped steel web 22, and when the step has come into contact with the supporting rolls 32*a* and 32*b* of the cradles 7 and 7', among the pair of cradles 7 and 7', the cradle 7 which initially supports the portion of the inner cylinder 23 wrapped with the steel web 22 would be subjected to abnormal load. In order to remove this abnormal load, sensors (not shown) contained in the roll bases 30*a* and 30*b* sense the abnormal load and input the sensed data to the central control unit 1, hence a command for designating a preliminarily programmed number of revolutions is issued from the central control unit 1 to drive the motor 27 for rotating the screw 29 by a predetermined number of revolutions, thereby the roll bases 30*a* and 30*b* and the supporting rolls 32*a* and 32*b* are separated from each other by prescribed dimensions in the left and right directions, and thus adjustment is achieved such that normal load may be applied to the cradle 7. Furthermore, the inner cylinder 23 continues to rotate and wrapping of the steel web 22 proceeds, and when the above-mentioned step has come into contact with the supporting rolls 32*a* and 32*b* of the other cradle 7', also a similar operation to that described above is effected.

When the inner cylinder 23 has made one revolution, the prescribed gap a has been formed at the wrapping section of the steel web 22 and the portion to be welded has come to the position of the wire feed nozzle 39 of the automatic welding machine 11, the position of the wire feed nozzle 39 is finely adjusted by the nozzle guide 40 provided in the automatic welding machine 11 so as to come right above the gap a, thereafter welding is commenced, and further, during the welding also, the position of the wire feed nozzle 39 is made to follow the weld portion by means of the nozzle guide 40, so that automatic adjustment is achieved in such manner that the welding arc may be generated always at the center of the gap a. Simultaneously therewith, the depressing rolls 9*c* for constraining the weld portion are lowered and urged against the surface of the steel web 22 by the hydraulic cylinders 24*c*, thus jointly with the already urged depressing rolls 9*b* for wrapping, they constrain under pressure the opposite sides of the weld portion of the steel web 22 to prevent generation of strains caused by welding.

In the automatic grinding machine 41 for grinding excess metal of welding that is set in position above the edge weld portion of the steel web 22, the grinding wheel 47 is continuously rotated by a motor (not shown) contained therein, and is urged against a weld complete portion 33 by means of the springs 43. The guide rolls 46 provided on the opposite sides of the grinding wheel 47 have their direction adjusted at the same angle as the wrapping angle $\theta$, have the bottoms of their outer circumferential surface adjusted at the same level (as viewed in the radial direction of the inner cylinder 23) as the bottom (grinding point) of the outer circumferential surface of the grinding wheel 47, and are urged against the surface of the wrapped steel web 22 jointly with the grinding wheel 47 by means of the springs 43 to serve as a stopper so that grinding of the steel web 22 in excess of the necessary extent can be prevented. As the welding is started and the inner cylinder 23 is rotated, when excess metal on the weld complete portion 33 of the steel web 22 has come into contact with the rotating grinding wheel 47, the grinding is commenced. During the grinding also, the guide rolls 46 always guide the grinding wheel 47 along the surface of the wrapped steel web 22, so that grinding work is achieved in such manner that the ground surface of the weld complete portion 33 may become flush with the surface of the steel web 22. When the inner cylinder 23 has made one revolution and the weld complete portion 33 with the excess metal ground has come to the position of the automatic magnetic defect hunter 12, magnetic defect hunting in the weld portion is commenced, and the detected data are sent to the central control unit 1, in which the defects and the like of the weld complete portion 33 are recorded by a printer contained in the central control unit 1.

After the above-described operation was carried out continuously, when the wrapping and welding of the steel web 22 have been completed, the operation of the apparatus is once stopped, the depressing rolls 9*a*, 9*b* and 9*c* are raised, then the steel web 22 is cut in parallel to the end of the inner cylinder 23 on the side of the drive mechanism 5, and it is fixed to the inner cylinder 23 by temporary welding. Again the operation is recommenced, and when the excess metal grinding work and the magnetic defect hunting for the remaining weld complete portion 33 have been completed, formation of the first layer is completed. In order that the elevator table 26 may not strike against the chuck 6 at this time, the inner cylinder 23 is provided with a surplus length. The record of the defects and the like in the weld complete portion which have been magnetically hunted as described above, is inspected, and if necessary, repairs of the weld portion are effected. Upon wrapping the second layer, since the outer diameter of the spiral tube is larger than that of the inner cylinder 23 by the amount corresponding to the thickness of the steel web 22, if a steel plate of the same width is used, the wrapping angle $\theta$ will become slightly smaller. Therefore, after the data input to the central control unit 1 have been corrected and the wrapping angle has been changed, commands are issued to the respective devices, so that the positions of the automatic hydraulic pressure control devices 25, the directions of the depressing rolls 9*a*, 9*b* and 9*c*, the position of the automatic welding machine 11, the position of the automatic grinding machine 41, the position of the automatic laser gap detector 10 and the position of the steel web feed table 15 are automatically finely adjusted, and thereafter, the same operation as that for the above-described first layer is carried out.

The above-mentioned operations are carried out repeatedly the number of times equal to the necessary number of layers, and thereby a multi-layer spiral tube having a predetermined wall thickness can be fabricated. The thus formed multi-layer spiral tube is completed after the unnecessary portions at the opposite ends including the surplus length portions at the opposite ends of the inner cylinder 23 and the temporarily welded portions of the steel web 22, have been cut away.

According to the present invention, since the respective component devices are automatically controlled by the commands issued from the central control unit containing a computer therein and the operations such as adjustment of rotation, feed and cradles, welding, excess metal grinding and the like can be achieved automatically and continuously except for the time of starting and the time of completion of wrapping, human labor necessitated for these operations can be saved, and further, a working efficiency can be greatly improved. In addition, owing to the fact that the urging by means of the depressing rolls for wrapping a web is automatically controlled accurately without employing manual control which relies upon eye measurement and the sixth sense and also fine adjustment of the web feed table position is jointly employed, the gap between the adjacent edge portions of the web can be maintained uniform, and hence a weld portion of good quality can be obtained. Furthermore, as a result of the fact that the edge portions of the web are welded as constrained under pressure by jointly employing the depressing rolls for constraining a weld portion and the depressing rolls for wrapping, swelling of the web caused by welding strain can be completely precluded, hence formation of a spiral tube is effected with the gap clearance between adjacent layers restricted to the minimum, and so, it is possible to obtain a multi-layer structure of high quality.

Since many changes and modifications could be made to the above-described construction, it is intended that all matter contained in the above description and illustrated in the accompanying drawings shall be interpreted to be illustrative and not as a limitation to the scope of the invention.

What is claimed is:

1. An apparatus for fabricating multi-layer spiral tubes, comprising first drive means for performing rotation of an inner cylinder around which a web is to be wrapped spirally, a slide base moveable along the longitudinal direction of said inner cylinder, said slide base being disposed on a bed so as to be slidable along the longitudinal direction of said inner cylinder, a plurality of pairs of cradles mounted on said slide base for placing said inner cylinder thereon, first depressing rolls for wrapping said web, second depressing rolls for constraining a weld portion of said web, an automatic gap detector for detecting a gap between adjacent edge portions of said wrapped web, an automatic welding machine for welding edge portions of said wrapped web, an automatic grinding machine for grinding excess metal of welding, an automatic defect hunter for detecting defects in the weld portion, a web feed table for feeding said web, second drive means for moving said web feed table, and a central control unit coupled to said first drive means, said cradles, said first depressing rolls, said second depressing rolls, said automatic gap detector, said automatic welding machine, said automatic grinding machine, said automatic defect hunter, said web feed table and said second drive means, to control the operations of these component means in a concentrated manner.

* * * * *

UNITED STATES PATENT AND TRADEMARK OFFICE

CERTIFICATE OF CORRECTION

PATENT NO. : 4,640,453

DATED : February 3, 1987

INVENTOR(S) : Tsutomu OE et al.

It is certified that error appears in the above-identified patent and that said Letters Patent is hereby corrected as shown below:

Column 1, line 26, for "after" read --often--.

Signed and Sealed this

Eleventh Day of August, 1987

*Attest:*

DONALD J. QUIGG

*Attesting Officer*

*Commissioner of Patents and Trademarks*